US008498562B2

(12) United States Patent
Yonekawa

(10) Patent No.: US 8,498,562 B2
(45) Date of Patent: Jul. 30, 2013

(54) FIXING DEVICE AND IMAGE FORMING APPARATUS COMPRISING THE SAME

(75) Inventor: Noboru Yonekawa, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 323 days.

(21) Appl. No.: 13/119,008

(22) PCT Filed: Sep. 8, 2009

(86) PCT No.: PCT/JP2009/004434
§ 371 (c)(1),
(2), (4) Date: Mar. 15, 2011

(87) PCT Pub. No.: WO2010/032398
PCT Pub. Date: Mar. 25, 2010

(65) Prior Publication Data
US 2011/0194881 A1 Aug. 11, 2011

(30) Foreign Application Priority Data
Sep. 18, 2008 (JP) ..... 2008-239702

(51) Int. Cl.
*G03G 15/20* (2006.01)

(52) U.S. Cl.
USPC ..... 399/329

(58) Field of Classification Search
USPC .. 399/107, 110, 122, 320, 328, 329; 219/216, 219/619
See application file for complete search history.

(56) References Cited

U.S. PATENT DOCUMENTS

| | | | | |
|---|---|---|---|---|
| 5,752,148 | A | 5/1998 | Yoneda et al. | |
| 6,021,303 | A | 2/2000 | Terada et al. | |
| 7,049,562 | B2 | 5/2006 | Tanino et al. | |
| 7,257,361 | B2 * | 8/2007 | Takagi et al. | 399/330 |
| 7,368,687 | B2 * | 5/2008 | Kagawa | 219/619 |

FOREIGN PATENT DOCUMENTS

| | | | |
|---|---|---|---|
| JP | 8-137306 | A | 5/1996 |
| JP | 2005-189425 | A | 7/2005 |
| JP | 3882800 | B2 | 2/2007 |
| JP | 2007-108212 | A | 4/2007 |
| JP | 2007-108392 | A | 4/2007 |
| JP | 3988251 | B2 | 10/2007 |

OTHER PUBLICATIONS

International Search Report (PCT/ISA/210) issued on Oct. 27, 2009, by Japanese Patent Office as the International Searching Authority for International Application No. PCT/JP2009/004434.
Japanese Office Action issued on Oct. 15, 2009 in JP 2008-239702 (with English language translation).

* cited by examiner

*Primary Examiner* — Hoan Tran
(74) *Attorney, Agent, or Firm* — Buchanan Ingersoll & Rooney PC

(57) ABSTRACT

Provided is a fixing device that uses an induction heating method and is capable of shortening a warm-up time period by accelerating the speed of increase in the temperature of a fixing belt. The fixing device forms a fixing nip by having a pressurizing roller pressurize a fixing roller, which is positioned inside a rotation path of a fixing belt having a hollow cylindrical shape, from outside the rotation path via the fixing belt. Given that Db is an inner diameter of the fixing belt, Dr is an outer diameter of the fixing roller, and a rate X is a value obtained by dividing the inner diameter Db of the fixing belt by the outer diameter Dr of the fixing roller, the fixing belt and the fixing roller that satisfy a relationship $0<X\leqq 1.18$ are used.

9 Claims, 5 Drawing Sheets

| Belt's inner diameter/ roller's outer diameter | Rate X |
|---|---|
| 40/40 | 1.00 |
| 40/39 | 1.03 |
| 40/38 | 1.05 |
| 40/36 | 1.11 |
| 40/34 | 1.18 |
| 40/32 | 1.25 |
| 40/28 | 1.43 |
| 40/25 | 1.60 |
| 50/50 | 1.00 |
| 50/48 | 1.04 |
| 50/46 | 1.09 |
| 50/44 | 1.14 |
| 50/42 | 1.19 |
| 50/40 | 1.25 |
| 50/36 | 1.39 |
| 50/32 | 1.56 |

- Temperature increase speed rate: belt with $\phi 40$
- Temperature increase speed rate: belt with $\phi 50$
- Belt flap: belt with $\phi 40$
- Belt flap: belt with $\phi 50$

FIXING DEVICE AND IMAGE FORMING APPARATUS COMPRISING THE SAME

TECHNICAL FIELD

The present invention relates to a fixing device using an induction heating method and an image forming apparatus comprising the same.

BACKGROUND ART

An image forming apparatus (e.g., a printer) comprises a fixing device that causes a sheet on which an unfixed image (e.g., toner) is formed to pass through a fixing nip, and fixes the unfixed image onto the sheet by heat and pressure at the fixing nip. In recent years, fixing devices that use an induction heating method have come into practical use in recent years (note, "induction heating" means heating by electromagnetic induction herein). Such fixing devices can save more energy than fixing devices that use a halogen heater as a heat source.

As one example of fixing devices using the induction heating method, Patent Literature 1 discloses a fixing device comprising: a fixing roller composed of a core metal, an outer circumference of which is covered by an induction heating layer via a thermal insulation sponge layer; a pressurizing roller that forms a fixing nip by pressurizing the fixing roller; and a magnetic flux generator that is provided in the vicinity of the fixing roller and generates magnetic flux for causing the induction heating layer of the fixing roller to generate heat.

Patent Literature 2 discloses a fixing device comprising: a first roller; a heat generation member having an induction heating layer; a belt that is suspended by the first roller and the heat generation member in a tensioned manner due to the force of a spring; a second roller that forms a fixing nip by pressurizing the first roller via the belt; and a magnetic flux generator that (i) is positioned facing the heat generation member via the belt while maintaining a certain distance from the surface of the belt and (ii) causes the induction heating layer of the heat generation member to generate heat.

CITATION LIST

Patent Literature

[Patent Literature 1]
Japanese Patent No. 3882800
[Patent Literature 2]
Japanese Patent No. 3988251

SUMMARY OF INVENTION

Technical Problem

Although the fixing device of Patent Literature 1 has the thermal insulation sponge layer, the fixing device of Patent Literature 1 cannot prevent heat loss, i.e., the induction heating layer losing its heat due to the heat transferring to the core metal via the sponge layer across the entire circumference of the fixing roller. Therefore, the fixing device of Patent Literature 1 can accelerate the speed of increase in the temperature of the fixing roller only to a certain extent.

Meanwhile, the fixing device of Patent Literature 2 is structured such that the heat generation member and the first roller are distanced from each other. This structure can prevent loss of the heat generated by the heat generation member, i.e., the heat transferring directly to the core metal of the first roller. The fixing device of Patent Literature 2 is also structured such that, with use of the belt that has a low heat capacity than the roller, the heat generated by the heat generation member reaches the fixing nip. Accordingly, the fixing device of Patent Literature 2 can use the heat generated by the heat generation member more efficiently than the fixing device of Patent Literature 1.

However, in the fixing device of Patent Literature 2, the heat generation member also acts as a tension member to maintain the tensioned state of the belt. Therefore, in order to transfer the heat generated by the heat-generating member to the belt evenly in a direction of the axis of the first roller while maintaining a certain tensioned state of the belt, the heat generation member needs to have great strength (e.g., a great thickness). However, such a heat generation member having great strength has a high heat capacity as well. This gives rise to the problem that, despite the low heat capacity of the belt, the speed of increase in the temperature of the belt cannot be accelerated.

The present invention has been made in view of the above problem, and aims to provide a fixing device that uses an induction heating method and is structured to accelerate the speed of temperature increase to shorten a warm-up time period. The present invention also aims to provide an image forming apparatus comprising such a fixing device.

Solution to Problem

In order to solve the above problem, one aspect of the present invention is a fixing device that causes a sheet on which an unfixed image is formed to pass through a fixing nip, and fixes the unfixed image onto the sheet by heat and pressure at the fixing nip, the fixing device utilizing an induction heating method and comprising: a belt that is rotated, includes an induction heating layer and has a substantially hollow cylindrical shape; a first roller positioned inside a rotation path of the belt; a second roller that forms the fixing nip between an outer surface of the second roller and an outer surface of the belt by pressurizing the first roller from outside the rotation path via the belt; and a magnetic flux generator that is positioned outside the rotation path and generates magnetic flux for causing the induction heating layer of the belt to generate heat, wherein a rate X of an inner diameter of the belt to an outer diameter of the first roller satisfies a relationship $1<X\leqq 1.18$.

Another aspect of the present invention is an image forming apparatus that forms an unfixed image on a sheet and causes a fixer included therein to fix the unfixed image onto the sheet, wherein the fixer is the above-described fixing device.

Advantageous Effects of Invention

When the fixing device is structured in the above manner, the following effects can be achieved. (a) As the rate X satisfies a relationship $X>1$, there is a space between an inner circumferential surface of the belt and an outer surface of the first roller, except for an area where the fixing nip is formed. This can prevent a problem of heat loss that occurs when the rate X satisfies a relationship $X=1$, i.e., the heat of the belt transferring to the entirety of the outer surface of the first roller due to the inner circumferential surface of the belt and the outer surface of the first roller being appressed to each other. (b) As the rate X satisfies a relationship $X\leqq 1.18$, the length of the belt is restricted with respect to the outer diameter of the first roller. This structure can shorten the warm-up time period by preventing the following problem that occurs when the rate X satisfies a relationship $X>1$: as a result of excessively lengthening the belt, the heat capacity of the belt itself is increased to the point where the effect of preventing the heat loss (heat transfer) can no longer be achieved. The above effects (a) and (b) improve usability of the image forming apparatus as they make it possible to not only save energy, but also shorten a time period for which a user has to wait to use the image forming apparatus thanks to the shortened warm-up time period.

DESCRIPTION OF EMBODIMENT

The following describes an embodiment of a fixing device and an image forming apparatus pertaining to the present invention, using an example of a tandem digital color printer (hereinafter simply referred to as a "printer").

(1) Overall Structure of Printer

Figure 1:
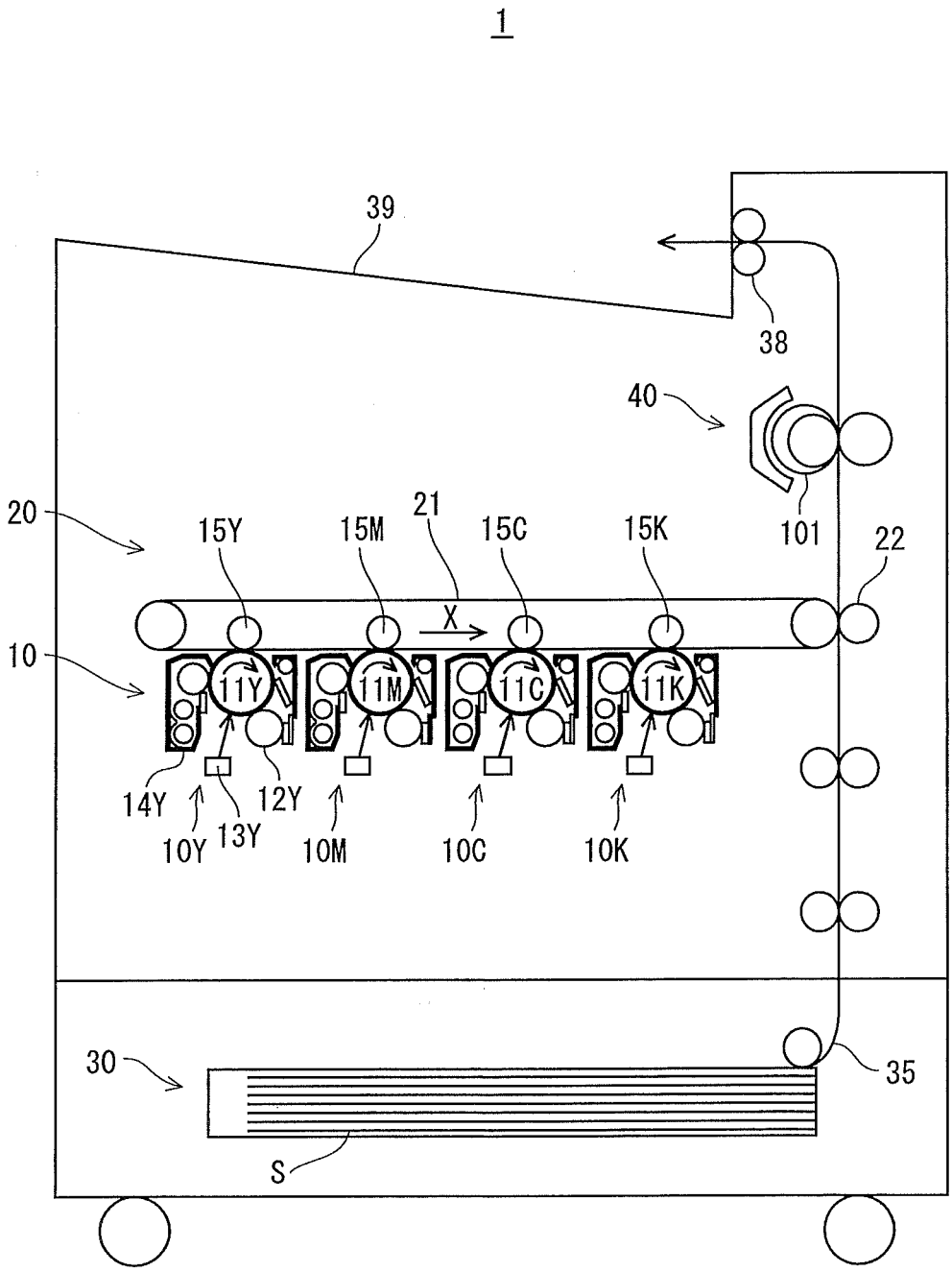
FIG. 1 shows an overall structure of a printer.

FIG. 1 shows an overall structure of a printer 1.

As shown in FIG. 1, the printer 1 forms an image using conventional electrophotography and is composed of an image processor 10, a belt conveyer 20, a feeder 30 and a fixer 40. The printer 1 is connected to a network (e.g., LAN). Upon receiving an instruction for executing a print job from an external terminal device (not illustrated), the printer 1 forms a full-color image using four colors, namely yellow (Y), magenta (M), cyan (C) and black (K), in accordance with the instruction.

The image processor 10 includes image forming units 10Y, 10M, 10C and 10K that correspond to Y, M, C and K, respectively. The image forming unit 10Y includes a photosensitive drum 11Y, a charger 12Y, an exposure subunit 13Y, a developer 14Y, a primary transfer roller 15Y, a cleaner for cleaning the photosensitive drum 11Y, and the like. The charger 12Y, the exposure subunit 13Y, the developer 14Y, the primary transfer roller 15Y and the cleaner are all disposed surrounding the photosensitive drum 11Y. The image forming unit 10Y forms a yellow toner image on the photosensitive drum 11Y by performing conventional charge, exposure and development processes. Other image forming units 10M, 100 and 10K are structured the same as the image forming unit 10Y, and form magenta, cyan and black toner images on the photosensitive drums 11M, 11C and 11K, respectively.

The belt conveyer 20 includes an intermediate transfer belt 21 that is rotated in the direction of arrow X. The feeder feeds recording sheets S from a feed cassette onto a conveyance path 35, one sheet at a time.

The toner image formed on the photosensitive drum 11Y (11K, 11C, 11M) is primary-transferred to the rotating intermediate transfer belt 21 in a transfer position on the photosensitive drum 11Y (11M, 11Y, 11K) by being subjected to electrostatic force exerted by the electric field generated between the primary transfer roller 15Y (15M, 15C, 15K) and the photosensitive drum 11Y (11M, 11Y, 11K). At this time, the image forming operations for the four colors are performed at different timings, so that the toner images of the four colors are transferred to the same position on the intermediate transfer belt 21, overlapping one another.

In accordance with these timings of image forming operations, the feeder 30 feeds a sheet S. The sheet S is conveyed while being held between the intermediate transfer belt 21 and a secondary transfer roller 22 that pressurizes the intermediate transfer belt 21. The toner images of the four colors on the intermediate transfer belt 21 are collectively secondary-transferred to the sheet S, by being subjected to the electrostatic force exerted by an electric field generated by secondary transfer voltage applied to the secondary transfer roller 22. After this secondary transfer, the sheet S is sent to the fixer 40.

The fixer 40 includes a fixing belt 101 and uses an induction heating method. After the secondary transfer, the fixer 40 fixes the toner images of the four colors onto the sheet S by applying heat and pressure to the sheet S. Once the toner images of the four colors have been fixed onto the sheet S, the sheet S is discharged to the outside of the printer 1 via a pair of discharge rollers 38, and deposited in a container tray 39.

(2) Structure of Fixer 40

Figure 2:
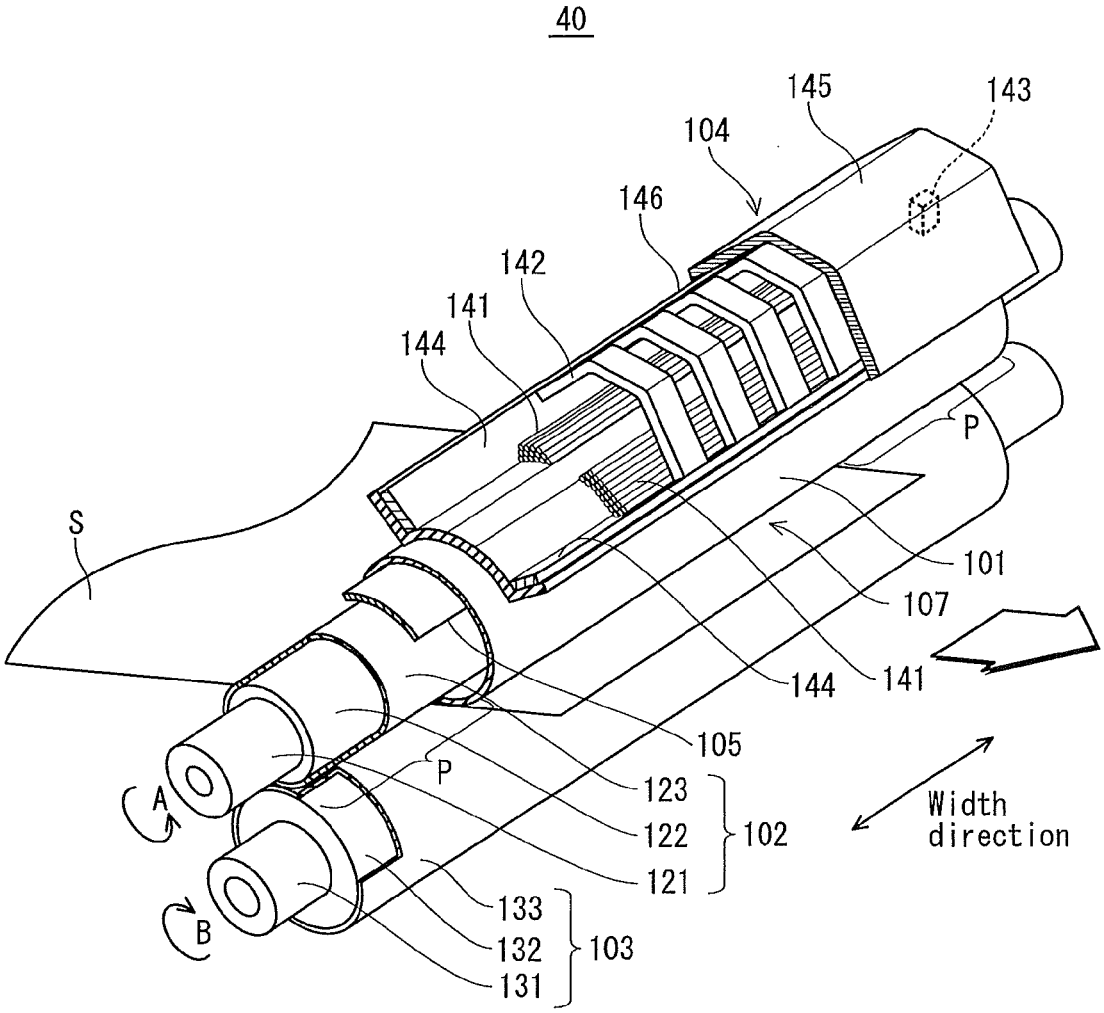
FIG. 2 is a perspective view showing the structure of a fixer included in the printer.
Figure 3:
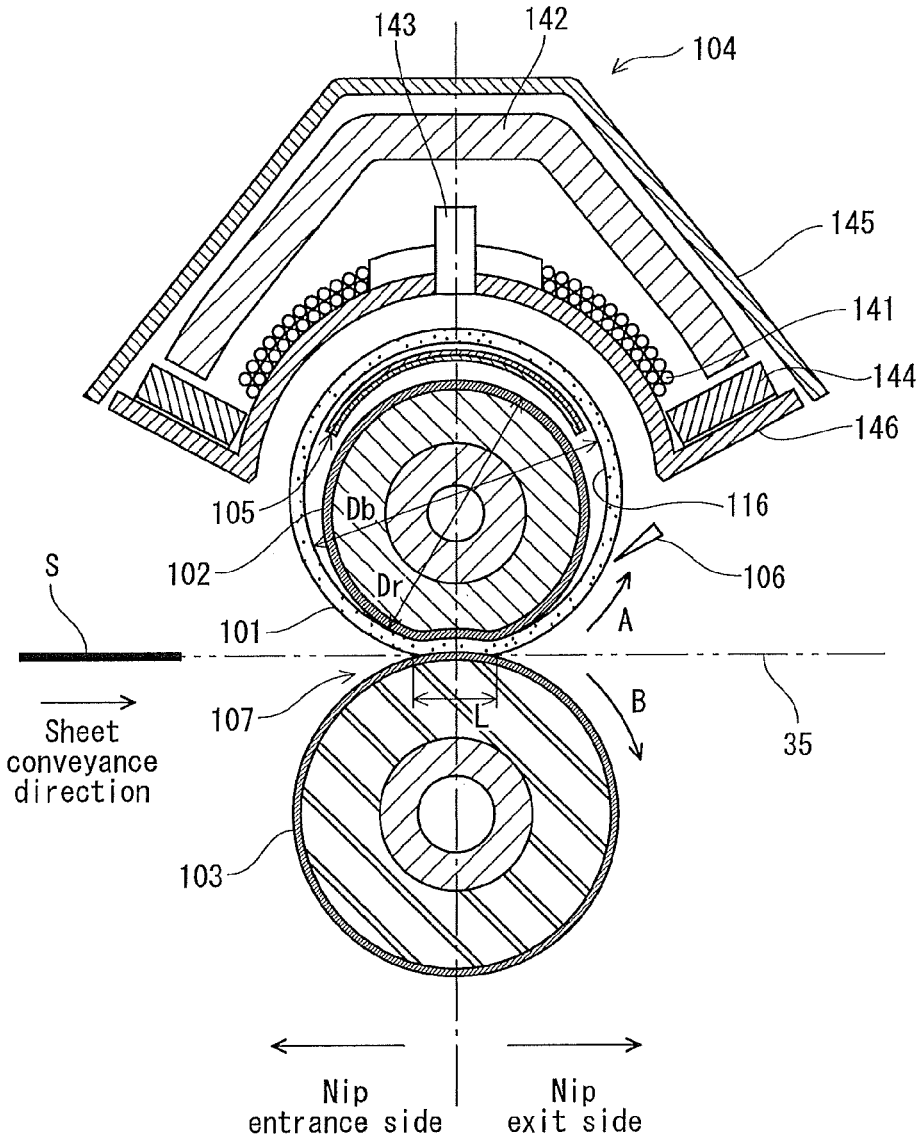
FIG. 3 is a cross-sectional view showing the structure of the fixer.
Figure 4:
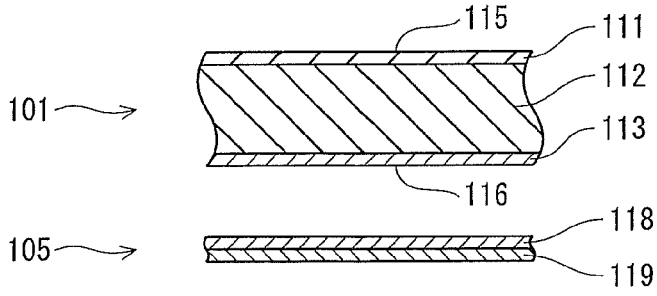
FIG. 4 is a cross-sectional view of a fixing belt included in the fixer.

FIG. 2 is a perspective view showing the structure of the fixer 40. FIG. 3 is a cross-sectional view showing the structure of the fixer 40. FIG. 4 is a cross-sectional view of the fixing belt 101. Note, the fixer 40 shown in FIGS. 2 and 3 is the fixer 40 shown in FIG. 1 rotated by approximately 90 degrees in a clockwise direction. Apart of the fixer 40 is omitted from the illustration of FIG. 2 for convenience of explanation.

As shown in FIGS. 2 to 4, the fixer 40 includes the fixing belt 101, a fixing roller 102, a pressurizing roller 103, a magnetic flux generator 104, a heat generation control member 105 and a separation claw 106.

<Structure of Fixing Belt 101>

The fixing belt 101 has a substantially hollow cylindrical shape and is rotated in the direction of arrow A. As shown in FIG. 4, the fixing belt 101 is composed of a release layer 111, an elastic layer 112 and a heat generation layer 113 that are layered in this order, with the release layer 111 constituting an outer surface 115 of the fixing belt 101. An inner diameter Db of the fixing belt 101 is 40 [mm]. The fixing belt 101 undergoes elastic deformation when a certain level of force is applied thereto in a direction of the diameter thereof. However, once the deformed fixing belt 101 has been released/disengaged from such a force, the fixing belt 101 reverts to its original hollow cylindrical shape due to its own reversibility. That is to say, the fixing belt 101 has a shape retaining property.

The length of the fixing belt 101 in a belt width direction (i.e., a direction of an axis of the fixing roller 102) is greater than the length of a sheet having the largest size in a sheet width direction. FIG. 2 shows a case where a sheet having a smaller size than the largest size passes through a fixing nip 107.

The release layer 111 is made of a tetrafluoroethylene-perfluoro (alkyl vinyl ether) copolymer (PFA) or the like, and has a thickness of 20[μm]. The elastic layer 112 is made of silicone rubber, fluororubber, or the like having (i) a thickness of 10[μm] to 800[μm], preferably 100 [μm] to 300[μm], and (ii) a JIS hardness of 1 to 80, preferably to 30. In the present embodiment, the elastic layer 112 is made of silicone rubber having a thickness of 200[μm] and a JIS hardness of 10.

The heat generation layer 113 is made of a nonmagnetic material, especially a nonmagnetic material with high electrical conductivity (e.g., copper and silver), having a thickness of 5[μm] to 40[μm]. The heat generation layer 113 generates heat due to magnetic flux generated by the magnetic flux generator 104. In the present embodiment, the heat generation layer 113 is made of copper having a thickness of 10[μm]. It should be noted that the heat generation layer 113 is not limited to being made of a nonmagnetic material, but may be made of, for example, a magnetic material (e.g., nickel) having a thickness of 40[μm] to 100[μm].

An antioxidizing layer may be additionally provided between the elastic layer 112 and the heat generation layer 113 for the following reason. When an oxide film is formed on one surface of the heat generation layer 113 facing the elastic layer 112 due to the (outer) air entering between the elastic layer 112 and the heat generation layer 113, the oxide film may decrease the adhesiveness between the elastic layer 112 and the heat generation layer 113. However, providing the antioxidizing layer in the above-described manner can prevent such decrease in adhesiveness. It is desirable that the antioxidizing layer (i) be made of a nonmagnetic low-resistance material (e.g., nickel, chrome and silver), and (ii) have a small thickness, more specifically, a thickness of 0.5[μm] to 40[μm].

<Structure of Fixing Roller 102>

The fixing roller 102 is composed of a core metal 121 having a long cylindrical shape, an elastic layer 122 and a surface layer 123, with the surface layer 123 layered around the circumference of the core metal 121 via the elastic layer 122. The fixing roller 102 has an outer diameter Dr of 36 [mm], and is positioned inside a rotation path of the fixing belt 101 (a path along which the fixing belt 101 is rotated).

The core metal 121 is made of aluminum or stainless steel. The elastic layer 122 is made of a rubber material, a resin material, or the like, and functions as a thermal insulation layer as well. The surface layer 123 is made of a PFA tube or the like. For instance, in a case where the thermal insulation layer 122 is made of a silicone sponge material, it is desirable that the thermal insulation layer 122 have a thickness of 1 [mm] to 10 [mm], preferably 2 [mm] to 7 [mm]. In this case, it is also desirable that the thermal insulation layer 122 have a hardness of 20 to 60, preferably 30 to 50, when measured by a Type-C ASKER Durometer. Note, it is permissible that the fixing roller 102 be structured without the surface layer 123.

<Structure of Pressurizing Roller 103>

The pressurizing roller 103 is composed of a core metal 131 having a long cylindrical shape, an elastic layer 132 and a release layer 133, with the release layer 133 layered around the circumference of the core metal 131 via the elastic layer 132. The pressurizing roller 103 has an outer diameter of 35 [mm], and is positioned outside the rotation path of the fixing belt 101. From outside the fixing belt 101, the pressurizing roller 103 pressurizes the fixing roller 102 via the fixing belt 101, and forms a fixing nip 107 between the pressurizing roller 103 and the outer surface 115 of the fixing belt 101. In the present embodiment, the pressurizing roller 103 pressurizes the fixing roller 102 at a force of 400 to 500 [N], and a length L of the fixing nip 107 in a sheet conveyance direction (a nip width L, see FIG. 3) is 11 [mm] to 12 [mm].

The core metal 131 is made of aluminum or the like. The elastic layer 132 is made of silicone sponge rubber or the like, and functions as a thermal insulation layer as well. The release layer 133 is a PFA coating, a polytetrafluoroethylene (PTFE) coating, or the like. It is desirable that the elastic layer 132 have a thickness of 3 [mm] to 10 [mm], and the release layer 133 have a thickness of 10[μm] to 50[μm].

The core metal 121 of the fixing roller 102 and the core metal 131 of the pressurizing roller 103 are rotatably supported by frames (not illustrated) at both axial ends thereof via axis supporting members or the like. The pressurizing roller 103 is rotated in the direction of arrow B, due to the drive force exerted by a drive motor (not illustrated) being transferred to the pressurizing roller 103. Driven by this rotation of the pressurizing roller 103, the fixing belt 101, as well as the fixing roller 102, is rotated in the direction of arrow A. Alternatively, the fixing roller 102 may be rotated by receiving the drive force from the drive motor, so that the rotation of the fixing roller 102 causes rotation of the fixing belt 101 and the pressurizing roller 103.

<Structure of Magnetic Flux Generator 104>

The magnetic flux generator 104 includes an excitation coil 141, a main core 142, two edge cores 143, two hem cores 144, a cover 145 and a coil bobbin 146. The magnetic flux generator 104 is positioned outside the rotation path of the fixing belt 101, in such a manner that the magnetic flux generator 104 (i) is on the opposite side of the fixing belt 101 across from the pressurizing roller 103, (ii) is away from the outer surface 115 of the fixing belt 101 by a predetermined distance, e.g., 1 [mm] to 2 [mm], and (iii) lies along the belt width direction.

The coil bobbin 146 is curved in the form of an arc along a direction of rotation of the fixing belt 101 (hereinafter, a "belt rotation direction"). The coil bobbin 146 is held in place by frames or the like at both ends thereof in the belt width direction.

The excitation coil 141, the main core 142, the edge cores 143 and the hem cores 144 are all positioned on the opposite side of the coil bobbin 146 across from the fixing belt 101.

The excitation coil 141 is connected to a drive circuit (not illustrated) including a high frequency inverter. By the drive circuit supplying high frequency power to the excitation coil 141, the excitation coil 141 generates magnetic flux for heating the heat generation layer 113 of the fixing belt 101. In the present embodiment, the high frequency power is described as, but not limited to, 20 [kHz] to 50 [kHz] power of 100 [W] to 2000 [W].

The main core 142 has a shape of an arch. In the present embodiment, the main core 142 is constituted from thirteen core parts that are positioned at intervals in the direction of the axis of the fixing roller 102, each core part having a width of 10 [mm] in the direction of the axis of the fixing roller 102. The main core 142 is not limited to having a shape of an arch. A cross-section of the main core 142 may have a shape of a capital letter "E" substantially, so that the middle protrusion of the main core 142 extends toward the fixing roller 102.

The edge cores 143 are respectively positioned in areas that correspond to the axial ends of the fixing roller 102. In the present embodiment, a cross-section of each edge core 143 has a shape of a square, and each edge core 143 has a length of 5 [mm] to 10 [mm]. A cross-section of each hem core 144 has a shape of a square. In the direction of the axis of the fixing roller 102, the length of each hem core 144 is substantially the same as that of the fixing roller 102. The hem cores 144 are respectively positioned at upstream and downstream ends of the coil bobbin 146 in the sheet conveyance direction, so that their longitudinal edges are in parallel with the direction of the axis of the fixing roller 102. Each core is made of a material that has high magnetic permeability and only loses a small amount of eddy current, such as ferrite and permalloy.

The magnetic flux generated by the excitation coil 141 is directed to the fixing belt 101 by the main core 142, the edge cores 143 and the hem cores 144, penetrates through the heat generation layer 113 of the fixing belt 101, and causes the heat generation layer 113 to generate an eddy current that makes the heat generation layer 113 generate heat.

The temperature of an area of the fixing nip 107 (a nip area) is increased by the heat generated by the heat generation layer 113 reaching the fixing nip 107 due to the rotation of the fixing belt 101. Although not illustrated, a sensor is independently provided to detect the temperature of the fixing belt 101. More specifically, the current temperature of the fixing belt 101 can be detected from a detection signal transmitted from this sensor. Power supply to the excitation coil 141 is controlled based on the current temperature detected, so as to maintain the temperature of the nip area at a target temperature, e.g., 180[° C.]. When the sheet S passes through the fixing nip 107 with the temperature of the fixing nip 107 maintained at the target temperature, heat and pressure are applied to the unfixed toner image on the sheet S, which results in the unfixed toner image being thermally fixed onto the sheet S.

<Structure of Heat Generation Control Member 105>

The heat generation control member 105 is positioned inside the rotation path of the fixing belt 101, facing the magnetic flux generator 104 via the fixing belt 101. The heat generation control member 105 has a shape of a long plate and a thickness of 0.2 [mm] to 2 [mm]. The heat generation control member 105 is curved along the belt rotation direction, so that the curvature thereof is substantially the same as the curvature of an inner surface 116 of the fixing belt 101. Thus, a cross-section of the heat generation control member 105 has a shape of an arc. In the belt width direction, the length of the heat generation control member 105 is greater than the width of the fixing belt 101. The heat generation control member 105 is supported by frames (not illustrated) at both ends thereof in the belt width direction, and is in contact with neither the fixing belt 101 nor the fixing roller 102.

As shown in FIG. 4, the heat generation control member 105 is composed of a heat generation control layer 118 and a low-resistance conductive layer 119, which are layered in this order with the heat generation control layer 118 being closer to the inner surface 116 of the fixing belt 101 than the low-resistance conductive layer 119 is.

The heat generation control layer 118 is made of a material whose Curie point is similar to the target temperature, such as iron, nickel, and permalloy. The heat generation control layer 118 transmutes from magnetic to nonmagnetic when the temperature thereof exceeds the Curie temperature. When the temperature of the heat generation control layer 118 is lowered to a temperature equal to or below the Curie temperature, the heat generation control layer 118 becomes magnetic again. That is to say, the property of the heat generation control layer 118 transmutes in a reversible manner. In the present embodiment, the heat generation control layer 118 is made of permalloy whose Curie temperature is higher than the target temperature by 20[° C.]. On the other hand, the low-resistance conductive layer 119 is made of a material having a low electrical resistance, such as copper and aluminum.

The heat generation control layer 118 and the low-resistance conductive layer 119 prevent excessive increase in the temperature of the fixing belt 101 in a case where a large number of small-sized sheets are printed in succession. Specifically, the small-sized sheets do not pass over portions P (FIG. 2) of the fixing belt 101 that are at both ends of the fixing belt 101 in the belt width direction (these portions P are referred to as contactless portions). While the small-sized sheets are being printed, the heat of these contactless portions P is not transferred to the small-sized sheets. Therefore, when the temperature of certain portions of the heat generation control layer 118 that correspond to the contactless portions P is increased above the target temperature and ultimately exceeds the Curie temperature, said certain portions of the heat generation control layer 118 transmute from magnetic to nonmagnetic. Once said certain portions of the heat generation control layer 118 transmute to nonmagnetic, it becomes easy for the magnetic flux generated by the magnetic flux generator 104 to penetrate into the low-resistance conductive layer 119 via the heat generation layer 113 and the heat generation control layer 118.

Certain portions of the low-resistance conductive layer 119 that correspond to the contactless portions P generate magnetic flux that is directed toward a direction to cancel out the magnetic flux that penetrates into said certain portions of the low-resistance conductive layer 119. This suppresses certain portions of the heat generation layer 113 that correspond to the contactless portions P from generating heat. These mechanisms can prevent the temperature of portions that correspond to the contactless portions P from exceeding the Curie temperature so greatly that the fixing belt 101 is damaged.

The Curie temperature is not limited to the above-described temperature as long as it can prevent excessive increase in the temperature of the fixing belt 101. Also, the materials of the heat generation control layer 118 and the low-resistance conductive layer 119 and the dimensions (e.g., a thickness) of the heat generation control member 105 are not limited to the ones described above.

There is only a small gap (space) between the inner surface 116 of the fixing belt 101 and the outer surface of the heat generation control layer 118. Hence, while the fixing belt 101 is being rotated, the inner surface 116 of the fixing belt 101 and the outer surface of the heat generation control layer 118 may briefly come in contact with each other in some areas depending on a degree of flapping of the fixing belt 101, the flapping being caused by the rotation of the fixing belt 101. However, the extent of this brief contact is too little to contribute to loss of the heat of the fixing belt 101, i.e., transfer of the heat of the fixing belt 101 to the heat generation control member 105.

<Separation Claw 106>

The separation claw 106 (FIG. 3) is positioned so that its tip is in contact with or adjacent to the outer surface 115 of the fixing belt 101. There is a case where the sheet S is still stuck to the outer surface 115 of the fixing belt 101 after passing through the fixing nip 107, due to the sheet S failing to be separated from the outer surface 115 of the fixing belt 101 despite the curvature of the fixing belt 101. In such a case, the separation claw 106 forcibly separates the sheet S from the fixing belt 101 by picking a front end of the sheet S in the sheet conveyance direction.

The fixer 40 of the present embodiment is structured such that (i) the fixing roller 102 is positioned inside the rotation path of the fixing belt 101 that has the heat generation layer 113; (ii) there is a space between the fixing belt 101 and the fixing roller 102, except for an area where the fixing nip 107 is formed; and (iii) in the space between the fixing belt 101 and the fixing roller 102, there is no tension member that applies tension to the fixing belt 101 in the direction of the diameter of the fixing belt 101 toward the outside of the fixing belt 101 (hereinafter, this structure is referred to as a "loosely-fit structure"). When the loosely-fit structure is used, the fixing belt 101 and the fixing roller 102 are in contact with each other only in the area where the fixing nip 107 is formed. Accordingly, using the loosely-fit structure has the effect of reducing the heat loss problem of Patent Literature 1, i.e., the heat generated by the heat generation layer transferring to the core metal (axial core) across the entire circumference of the fixing roller due to the heat generation layer being formed on the surface of the fixing roller instead of a belt.

Furthermore, use of the loosely-fit structure prevents the problem pertaining to the following structure of Patent Literature 2: because a certain degree of tension is applied to the fixing belt by having the fixing belt suspended in a tensioned manner by the fixing roller and the heat generation member, which also acts as a tension member, the heat generation member (tension member) needs to have great strength, which would increase the heat capacity of the heat generation member (tension member). Therefore, use of the loosely-fit structure can lower the heat capacity of the fixer 40, and accelerate the speed of increase in the temperature of the fixing belt 101 to shorten the warm-up time period.

As an example of the loosely-fit structure, it has been described in the present embodiment that the inner diameter Db of the fixing belt 101 is 40 [mm] and the outer diameter Dr of the fixing roller 102 is 34 [mm]. As described above, use of the loosely-fit structure can reduce the amount of heat loss (heat transfer) as compared to the structure of Patent Literature 1. However, if the inner diameter Db of the fixing belt 101 is too large (i.e., if the length of the circumference of the fixing belt 101 is too large) with respect to the fixing roller 102, then the heat capacity of the fixing belt 101 itself is increased, and thus the speed of increase in the temperature of the fixing belt 101 cannot be accelerated.

In view of the above issue, the inventor of the present invention has derived, from experiments and the like, a range of a rate of the inner diameter Db of the fixing belt 101 to the outer diameter Dr of the fixing roller 102 that can further accelerate the speed of increase in the temperature of the fixing belt 101. The specifics of such a range is described below.

(3) Ranges of Inner Diameter Db of Fixing Belt 101 and Outer Diameter Dr of Fixing Roller 102

Figure 5:
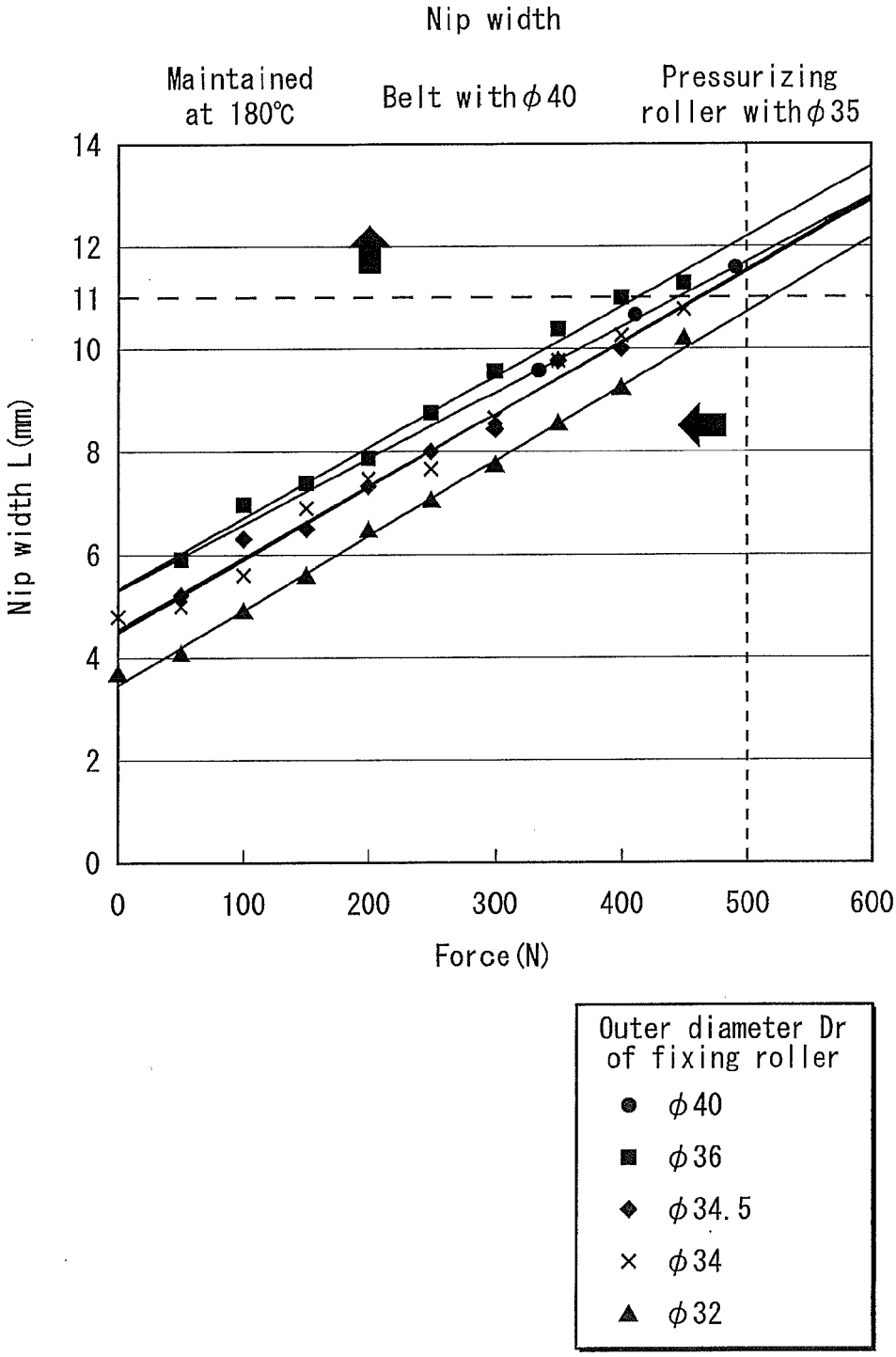
FIG. 5 illustrates a graph showing relationships between nip force applied to a fixing nip and a nip width L of the fixing nip.
Figure 6:
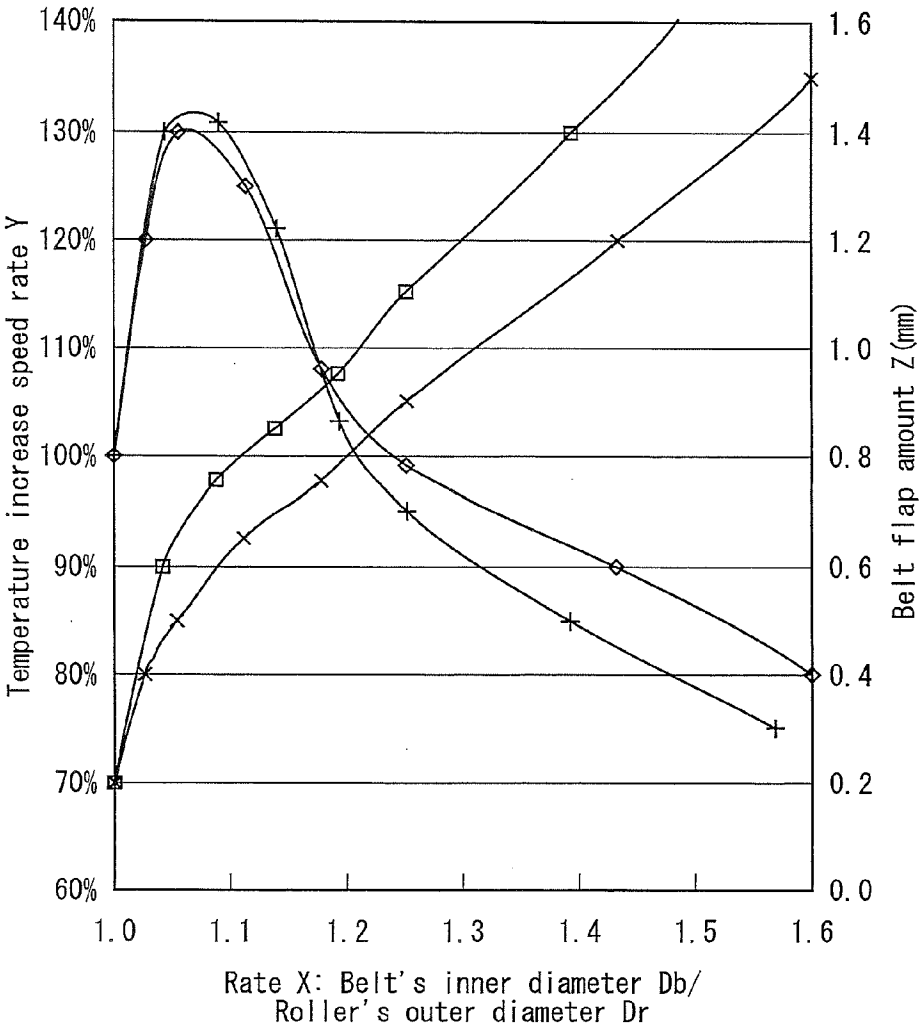
FIG. 6 illustrates a graph showing (i) relationships between a rate X and a temperature increase speed rate Y, and (ii) relationships between the rate X and a belt flap amount Z, the rate X being a rate of an inner diameter Db of the fixing belt to an outer diameter Dr of a fixing roller (i.e., Db/Dr).

FIG. 5 illustrates a graph showing relationships between nip force applied to the fixing nip 107 and a nip width L of the fixing nip 107. FIG. 6 illustrates a graph showing (i) relationships between a rate X and a temperature increase speed rate Y, and (ii) relationships between the rate X and a belt flap amount Z, the rate X being a rate of the inner diameter Db of the fixing belt 101 to the outer diameter Dr of the fixing roller 102 (X=Db/Dr).

The graph shown in FIG. 5 is derived from a case where the fixing belt 101 having an inner diameter Db of 40 [mm] and the pressurizing roller 103 having an outer diameter of 35 [mm] are used. In this case, five types of fixing rollers 102 are alternately used, which have outer diameters Dr of 32 [mm], 34 [mm], 34.5 [mm], 36 [mm] and 40 [mm], respectively. The graph of FIG. 5 shows results of measuring a nip width L for each of the five fixing rollers 102, while gradually increasing the applied nip force with the temperature of the fixing nip 107 maintained at 180[° C.]. In the graph of FIG. 5, a line for the fixing roller 102 having an outer diameter Dr of 34 [mm] and a line for the fixing roller 102 having an outer diameter Dr of 34.5 [mm] overlap with each other.

The nip force means force of pressure applied by the pressurizing roller 103 to the fixing roller 102, and is expressed in Newton (N) units. Note, when the fixing roller 102 having an outer diameter Dr of 40 [mm] is used in combination with the fixing belt 101 having an inner diameter Db of 40 [mm], it means that the fixer 40 is structured such that the inner surface 116 of the fixing belt 101 and the outer surface of the fixing roller 102 are appressed to each other (hereinafter, this structure is referred to as an appressed structure).

The fixing belt 101 having an inner diameter Db of 40 [mm] is generally used in a mid- to high-speed printer with a print speed of 40 [sheets/minute] to 65 [sheets/minute] and a system speed of 200 [mm/second] to 350 [mm/second] (the system speed is equivalent to a rotation speed of outer circumferences of the photosensitive drums, a sheet conveyance speed, etc.). By way of example, the printer 1 pertaining to the present embodiment has a system speed of 310 [mm/second].

As shown in FIG. 5, the greater the nip force, the greater the nip width L. Put another way, the nip force and the nip width L are substantially proportional to each other. From the past experiences it has been learned that when the print speed is 40 [sheets/minute] to 65 [sheets/minute], the nip force is preferably smaller than or equal to 500 [N] and the nip width L is preferably greater than or equal to 11 [mm].

The nip force is preferably within the above range because a nip force greater than 500 [N] would give rise to problems regarding durability of the pressurizing roller 103. The nip width L is preferably within the above range because a nip width L smaller than 11 [mm] would shorten a time period for which the sheet S passes through the fixing nip 107 due to the high system speed of the mid- to high-speed printer, with the result that toner particles may not be suitably fixed onto the sheet S while the sheet S is passing through the fixing nip 107. It is desirable that a time period required for a point on the sheet S to proceed by the nip width L be 40 [ms] to 60 [ms] or greater.

The graph of FIG. 5 indicates that a fixing nip 107 having a nip width L of 11 [mm] or greater can be formed with a nip force of 400 [N] to 500 [N] when the fixing belt 101 having an inner diameter Db of 40 [mm] is used in combination with the fixing roller 102 having an outer diameter Dr of 34 [mm] to 40 [mm] (not the fixing roller 102 having an outer diameter Dr of 32 [mm]). Also, the relationships between the outer diameter Dr of each fixing roller 102 and the nip width L indicate that the fixing roller 102 having an outer diameter Dr of 36 [mm] can form a fixing nip 107 having a greater nip width L than the fixing roller 102 having an outer diameter of 40 [mm]. This is presumably because the loosely-fit structure is more likely than the appressed structure to create a gap between the fixing belt 101 and the fixing roller 102 at the fixing nip 107 and cause deformation of the elastic layer 122 of the fixing roller 102. Furthermore, when a nip force of 400 [N] to 500 [N] is applied, the fixing roller 102 whose outer diameter Dr is smaller than 36 [mm] (e.g., the fixing rollers 102 having outer diameters Dr of 34 [mm] and 34.5 [mm]) can form a fixing nip 107 that has substantially the same nip width L as the fixing nip 107 formed by the fixing roller 102 having an outer diameter of 40 [mm]. From the above factors, use of the loosely-fit structure is also effective in forming a fixing nip 107 having a greater nip width L.

By way of example, the above has described a case where the fixing belt 101 having an inner diameter Db of 40 [mm] is used. However, the inventor of the present invention has also discovered that, when alternatively using fixing rollers 102 having different outer diameters Dr ranging between 32 [mm] and 50[μm] inclusive in combination with a fixing belt 101 having an inner diameter Db of 50 [mm], the resultant graph shows straight lines that are, as a whole, shifted above the straight lines shown in the graph of FIG. 5. This means that a fixing nip 107 having a nip width L of 11 [mm] or greater can be formed when a nip force of 500 [N] or smaller is applied.

FIG. 6 shows (i) the relationships between the rate X and the temperature increase speed rate Y and (ii) the relationships between the rate X and the belt flap amount Z, with respect to each of the fixing belt 101 having an inner diameter Db of 40 [mm] and the fixing belt 101 having an inner diameter Db of 50 [mm]. The "Belt's inner diameter/roller's outer diameter" in the table illustrated in FIG. 6 to the right of the graph shows examples of combinations between fixing belts 101 and fixing rollers 102. Below, when any combination between the fixing belts 101 and the fixing rollers 102 is to be described, the numeral values indicating the inner diameter Db and the outer diameter Dr of the described fixing belt 101 and fixing roller 102 will be simply given in the interest of brevity, such as "40/40" and "40/39". The points plotted in the graph are in one to one correspondence with values of the rate X shown in the table to the right of the graph (e.g., when the fixing belt 101 having an inner diameter Db of 40 [mm] is used, "1.00", "1.03", . . . "1.60").

The temperature increase speed rate Y expresses, in percentage, a rate of a temperature increase speed Vb of a case where the loosely-fit structure is used to a temperature increase speed Va of a case where the appressed structure is used (Va is a reference value). The temperature increase speed rate Y can be calculated using the equation Y=(Vb/Va)×100 [%]. Herein, the temperature increase speed is expressed in terms of a magnitude of increase in the temperature of the fixing nip 107 per unit time. For example, when a current temperature (e.g., 25[° C.]) of the fixing nip 107 is to be increased to the target temperature (180[° C.] herein), the temperature increase speed can be calculated by dividing a temperature difference (i.e., 155[° C.]) between the current temperature of the fixing nip 107 and the target temperature by a time period T required for the current temperature of the fixing nip 107 to reach the target temperature.

The graph of FIG. 6 shows the rate of the temperature increase speed pertaining to the loosely-fit structure (X>1) to the temperature increase speed pertaining to the appressed structure (X=1). Accordingly, when X=1, Va=Vb and Y=100 [%].

As shown in the graph of FIG. 6, when the loosely-fit structure is used (X>1), the value of the temperature increase speed rate Y could exceed 100[%], or become smaller than or equal to 100[%], depending on the scale of the rate X. The following describes in detail how the temperature increase speed rate Y is calculated with respect to each of the plotted points when the loosely-fit structure is used.

(a) Combination "40/39" (X=1.03)

The inventor of the present invention has created a fixing device comprising a combination "40/39" and measured the temperature increase speed Vb pertaining to this fixing device. Thereafter, the inventor of the present invention has created another fixing device comprising a combination "39/39" and measured the temperature increase speed Va pertaining to this fixing device. The both measurements have been conducted under the same conditions (e.g., the temperature of the fixing nip 107 at the time of starting the processing of increasing the temperature, the target temperature, etc.). The temperature increase speed rate Y has been calculated by substituting the results of these measurements into the above equation.

More specifically, the inventor of the present invention has prepared the following two combinations by using a fixing roller 102 having a certain outer diameter Dr (here, 39 [mm]): (i) a combination of the fixing roller 102 and a fixing belt 101 whose inner diameter Db is the same as the outer diameter Dr of the fixing roller 102 (the appressed structure); and (ii) a combination of the fixing roller 102 and a fixing belt 101 whose inner diameter Db is greater than the outer diameter Dr of the fixing roller 102 (the loosely-fit structure). Thereafter, the inventor of the present invention has calculated a rate of the temperature increase speed pertaining to one of the above combinations to the temperature increase speed pertaining to the other.

The graph shows that when X=1.03, the value of the temperature increase speed rate Y is 120[%], i.e., greater than 100[%]. Note that when X>1, the temperature increase speed rate Y is a rate of the temperature increase speed Vb pertaining to the loosely-fit structure to the temperature increase speed Va pertaining to the appressed structure. Therefore, Y=120 [%] means that the combination "40/39" accelerates the temperature increase speed by 20% as compared to the combination "39/39" (X=1) in which the outer diameter Dr of the fixing roller 102 is the same as the inner diameter Db of the fixing belt 101 (the appressed structure). The more accelerated the temperature increase speed, the shorter the warm-up time period.

(b) Combination "40/38" (X=1.05)

Similarly, the inventor of the present invention has measured (i) the temperature increase speed Vb pertaining to a fixing device comprising a combination "40/38", and (ii) the temperature increase speed Va pertaining to another fixing device comprising a combination "38/38". The temperature increase speed rate Y has been calculated by substituting the results of these measurements into the above equation. The graph shows that when X=1.05, the value of the temperature increase speed rate Y is 130[%]. Hence, the combination "40/38" accelerates the temperature increase speed as compared to the combination "38/38" (X=1) in which the outer diameter Dr of the fixing roller 102 is the same as the inner diameter Db of the fixing belt 101 (the appressed structure).

(c) Combination "40/25" (X=1.60)

Similarly, the inventor of the present invention has measured (i) the temperature increase speed Vb pertaining to a fixing device comprising a combination "40/25", and (ii) the temperature increase speed Va pertaining to another fixing device comprising a combination "25/25". The temperature increase speed rate Y has been calculated by substituting the results of these measurements into the above equation. The graph shows that when X=1.60, the value of the temperature increase speed rate Y is 80[%]. Contrary to the two combinations described above, the combination "40/25" decelerates the temperature increase speed by 20% as compared to the combination "25/25" (X=1) in which the outer diameter Dr of the fixing roller 102 is the same as the inner diameter Db of the fixing belt 101 (the appressed structure). The more decelerated the temperature increase speed, the longer the warm-up time period. Note, the temperature increase speed rate Y is calculated in the same manner when other combinations are used, or when the fixing belt 101 having an inner diameter Db of 50 [mm] is used.

Referring to the graph of FIG. 6, the temperature increase speed rate Y changes in the following manner, whether the fixing belt 101 has an inner diameter Db of 40 [mm] or 50 [mm]. When X=1, Y=100[%]. As the values of X become greater than 1, the values of Y become greater than 100[%]. When the value of X has reached a certain value, the value of Y reaches its apex (has the largest value). From this point onward, as the values of X become greater than said certain value, the values of Y become smaller than the apex value and eventually go below 100[%].

As described above, the temperature increase speed rate Y is greater than 100[%] when the value of the rate X falls within a certain range, because the loosely-fit structure can suppress the heat loss (heat transfer) to a greater extent than the appressed structure. In contrast, even if the loosely-fit structure is used, the temperature increase speed rate Y becomes smaller than 100[%] when the value of the rate X falls within another certain range. This is because when the value of the rate X falls within said another certain range, the heat capacity of the fixing belt 101 itself becomes large due to excessive increase in the circumferential length of the fixing belt 101, which results in deceleration of the temperature increase speed. The value of X corresponding to the apex value of the temperature increase speed rate Y is retrieved from the combination that yields the greatest effect of reducing the heat capacity by suppressing the heat loss (heat transfer).

The values of the temperature increase speed rate Y become smaller than the apex value for the following reason. As the values of the rate X increase, the circumferential length of the belt becomes long as compared to the appressed structure. As a result, the heat capacity of the belt itself is increased, lowering the effect of reducing the heat capacity by suppressing the heat loss (heat transfer). The values of the temperature increase speed rate Y become smaller than 100 [%] because the heat capacity of the belt itself has been increased to the point where the effect of reducing the heat capacity by suppressing the heat loss (heat transfer) can no longer be achieved.

As can be seen from the graph of FIG. 6 showing the temperature increase speed rate Y, when the fixing belt 101 having an inner diameter Db of 40 [mm] is used, the range of the values of X that corresponds to the plotted points for values of Y exceeding 100[%] is between 1.03 and 1.18 inclusive. The range of the outer diameter Dr of the fixing roller 102 that corresponds to the above range of the value of X is between 34 [mm] and 39 [mm] inclusive. This range of the outer diameter Dr, namely between 34 [mm] and 39 [mm] inclusive, falls within a preferred range of the outer diameter Dr of the fixing roller 102, namely between 34 [mm] and 40 [mm] inclusive, which is established based on the relationships between the nip force and the nip width L shown in FIG. 5.

Therefore, using the fixing belt 101 having an inner diameter Db of 40 [mm] in combination with the fixing roller 102 having an outer diameter Dr ranging between 34 [mm] and 39 [mm] inclusive can not only form a fixing nip 107 having a preferred nip width L, but also shorten the warm-up time period.

Similarly, as can be seen from the graph of FIG. 6, when the fixing belt 101 having an inner diameter Db of 50 [mm] is used, the range of the values of X that corresponds to the plotted points for values of Y exceeding 100[%] is between 1.04 and 1.19 inclusive. The range of the outer diameter Dr of the fixing roller 102 that corresponds to the above range of the value of X is between 42 [mm] and 48 [mm] inclusive. As described above, it has been discovered that when the fixing belt 101 having an inner diameter Db of 50 [mm] is used in combination with the fixing roller 102 having an outer diameter Dr ranging between 32 [mm] and 50 [mm] inclusive, a fixing nip 107 having a nip width L of 11 [mm] or greater can be formed. Therefore, using the fixing belt 101 having an inner diameter Db of 50 [mm] in combination with the fixing roller 102 having an outer diameter Dr ranging between 42 [mm] to 48 [mm] inclusive can not only form a fixing nip 107 having a preferred nip width L, but also shorten the warm-up time period.

<Belt Flap Amount Z>

The belt flap amount Z is an amount of displacement (stroke) of the rotating fixing belt 101 in the direction of the diameter of the fixing belt 101, the amount of displacement being measured in a predetermined position on the rotation path of the fixing belt 101, excluding the area where the fixing nip 107 is formed.

In the present experiment, said predetermined position is a position on the rotation path of the fixing belt 101 that satisfies both of the following conditions: (i) facing the coil bobbin 146; and (ii) being the most upstream position in the belt rotation direction. The belt flap amount Z is measured in this predetermined position for the following reason: because the flap amount of the fixing belt 101 is generally larger immediately after it has passed the fixing nip 107 than immediately before it enters the fixing nip 107, the belt flap amount Z having the largest value can be measured in the predetermined position.

The larger the belt flap amount Z, the more it is likely that the outer surface 115 of the fixing belt 101 get scratched by hitting the coil bobbin 146 and the separation claw 106 during the rotation of the fixing belt 101. The scratches on the outer surface 115 makes the outer surface 115 concavo-convex. When a toner image is pressurized by the concave-convex outer surface 115 at the fixing nip 107, the surface of the fixed toner image may also become concavo-convex, which could lead to image noise (e.g., deterioration in gloss of the formed image).

Moreover, with the fixing belt 101 hitting the separation claw 106, toner may attach to the tip of the separation claw 106. The attached toner accumulates and forms into a lump of toner, which may fall from the tip of the separation claw 106 onto the conveyance path 35 and smudge the sheet S.

For the above reasons, the belt flap amount Z is preferably as small as possible. However, the loosely-fit structure necessitates flapping of the fixing belt 101 to some extent. Therefore, when the loosely-fit structure is used, the flapping amount is required to be smaller than or equal to an amount that does not cause deterioration in image quality. For instance, the belt flap amount Z should be suppressed to be smaller than or equal to 1.0 [mm], preferably smaller than or equal to 0.8 [mm]. It has been confirmed that when the belt flap amount Z is greater than 1.0 [mm], the outer surface 115 of the fixing belt 101 is easily scratched owing to the distance (1 [mm] to 2 [mm]) between the fixing belt 101 and the coil bobbin 146, and that when the belt flap amount Z is suppressed to be smaller than or equal to 0.8 [mm], image noise and smudges on a sheet can be mostly prevented.

It is apparent from the graph of FIG. 6 illustrating the belt flap amount Z that, in a case where the fixing belt 101 having an inner diameter Db 40 [mm] is used, the value of Z is smaller than or equal to 0.8 [mm] when the value of X is smaller than or equal to 1.18. This value of X smaller than or equal to 1.18 falls within the range of the value of X that realizes the relationship Y>100[%] (X=1.03 to 1.18 inclusive).

On the other hand, in a case where the fixing belt 101 having an inner diameter Db of 50 [mm] is used, the value of Z is smaller than or equal to 1.0 [mm] when the value of X is smaller than or equal to 1.19. This value of X smaller than or equal to 1.19 falls within the range of the value of X that realizes the relationship Y>100[%] (X=1.04 to 1.19 inclusive). Note, in a case where the fixing belt 101 having an inner diameter Db of 50 [mm] is used, the value of Z is smaller than or equal to 0.8 [mm] when the value of X is smaller than or equal to 1.09. Accordingly, setting the rate X to a value ranging between 1.04 and 1.09 inclusive can shorten the warm-up time period and prevent image noise and the like.

As has been described above, when the loosely-fit structure is used while restricting the inner diameter Db (belt length) of the fixing belt 101 with respect to the outer diameter Dr of the fixing roller 103, it is possible to (i) suppress the heat loss (heat transfer) to a greater extent than when the appressed structure is used, and (ii) prevent the effect of suppressing such heat loss (heat transfer), i.e., the effect of reducing the heat capacity of the fixing belt 101, from being reduced due to increase in the heat capacity of the fixing belt 101 as a result of making the fixing belt 101 too long in the belt rotation direction. Accordingly, the loosely-fit structure can further accelerate the speed of increase in the temperature of the fixing belt 101 to shorten the warm-up time period. Furthermore, as the loosely-fit structure can sufficiently reduce the belt flap amount Z without providing another tension member for suspending the fixing belt 101 in a tensioned manner, the loosely-fit structure can further reduce the heat capacity as compared to the structure of Patent Literature 2. Especially, use of the loosely-fit structure is more advantageous for the aforementioned mid- to high-speed printer, because the mid- to high-speed printer tends to prolong the warm-up time period since a fixing belt and a fixing roller included therein have a greater belt length and a greater outer diameter, respectively, than those included in a low-speed printer.

The graph of FIG. 6 showing the temperature increase speed rate Y is derived from cases where the fixing belt 101 having an inner diameter Db of 40 [mm] and the fixing belt 101 having an inner diameter Db of 50 [mm] are used. However, the fixing belts 101 having inner diameters Db of 40 [mm] and 50 [mm] are not the only ones that result in such a graph showing the temperature increase speed rate Y with a curved line. A fixing belt 101 having a different inner diameter Db than 40 [mm] and 50 [mm] substantially results in such a graph showing the temperature increase speed rate Y with a curved line as well. For example, when the inner diameter Db of the fixing belt 101 satisfies the relationship $40<Db<50$ [mm], the resultant graph shows a curved line that lies between the curved lines of FIG. 6, which are derived from the fixing belts 101 having inner diameters Db of 40 [mm] and 50 [mm]. The resultant graph also indicates that, as with the cases where the fixing belts 101 having inner diameters Db of 40 [mm] and 50 [mm] are used, the loosely-fit structure can achieve the relationship $Y>100$[%], i.e., accelerate the temperature increase speed as compared to the appressed structure, when X satisfies the relationship $1<X\leqq1.18$.

Similarly, when the inner diameter Db of the fixing belt 101 satisfies the relationship $50<Db\leqq60$ [mm], the resultant graph shows the following information: when $X=1$, $Y=100$ [%]; as the values of X become greater than 1, the values of Y increase; the apex value of Y is slightly larger than that of the curved line derived from the fixing belt 101 having an inner diameter of 50 [mm] (by approximately a few percent); after reaching the apex, the values of Y decrease, and Y becomes 100[%] when X is approximately 1.2; and once the values of Y become smaller than 100 [mm], a curved line for Y slopes downward along the curved line derived from the fixing belt 101 having an inner diameter of 50 [mm], in such a manner that the former is shifted below the latter by approximately a few percent. The resultant graph also indicates that the loosely-fit structure can achieve the relationship $Y>100$[%], i.e., accelerate the temperature increase speed, when X satisfies the relationship $1<X\leqq1.18$. A graph derived from a fixing belt 101 having an inner diameter Db greater than 60 [mm] also shows a curved line having a similar shape to the ones described above.

In contrast, when the inner diameter Db of the fixing belt 101 is smaller than 40 [mm], e.g., satisfies the relationship $30\leqq Db<40$ [mm], the resultant graph shows the following information: the apex value of Y is slightly smaller than that of the curved line derived from the fixing belt 101 having an inner diameter Db of 40 [mm]; and once the values of Y become smaller than 100[%], a curved line for Y slopes downward along the curved line derived from the fixing belt 101 having an inner diameter Db of 40 [mm], in such a manner that the former is shifted above the latter by approximately a few percent. The resultant graph also indicates that the loosely-fit structure can achieve the relationship $Y>100$ [%] when X satisfies at least the relationship $X\leqq1.18$.

As set forth above, it has been discovered that the relationship between the inner diameter Db of the fixing belt 101 and the outer diameter Dr of the fixing roller 102 results in a graph showing a curved line that has substantially the same shape as the curved lines shown in FIG. 6, whether the relationship is defined by any of the above-described combinations of numeral values or not. Accordingly, as long as X satisfies the relationship $1<X\leqq1.18$, the loosely-fit structure can achieve the relationship $Y>100$[%], i.e., shorten the warm-up time period by accelerating the temperature increase speed.

Although the rate X may have any value as long as it satisfies the relationship $1<X\leqq1.18$, it is preferable for the rate X to satisfy the relationship $1<X\leqq1.18$ and correspond to either the apex value of Y or a value of Y that is in the vicinity of the apex value. The rate X is set to a proper value in advance based on experiments or the like.

Modification Examples

The present invention has been described above based on the embodiment thereof. However, it goes without saying that the present invention is not limited to being implemented based on the above embodiment. The following modification examples are possible.

(1) The above embodiment has described that the heat generation control member 105 is composed of the heat generation control layer 118 and the low-resistance conductive layer 119. However, the heat generation control member 105 is not limited to being structured in this manner. For example, the heat generation control member 105 may be composed solely of the low-resistance conductive layer 119, with the heat generation control layer 118 included in the fixing belt 101 instead. In this case, the fixing belt 101 is composed of the release layer 111, the elastic layer 112, the heat generation layer 113 and the heat generation control layer 118, which are layered in this order with the release layer 111 and the heat generation control layer 118 constituting the outer surface 115 and the inner surface 116 of the fixing belt 101, respectively. Furthermore, as the heat generation control member 105 is provided for the purpose of preventing an excessive temperature increase caused by use of small-sized sheets, the fixer 40 may not comprise the heat generation control member 105 in the following cases: the fixer 40 is structured such that use of the small-sized sheets does not cause such an excessive temperature increase; the small-sized sheets cannot pass through the fixer 40; and so on.

(2) By way of example, the above embodiment has described a case where the fixing device and the image forming apparatus of the present invention are applied to a tandem digital color printer. However, they are not limited to being applied to a tandem digital color printer. The fixing device of the present invention may be any fixing device, as long as it utilizes an induction heating method and is structured to (i) form a fixing nip by having a pressurizing roller pressurize a fixing roller, which is positioned inside a rotation path of a fixing belt that has a substantially hollow cylindrical shape, from outside the rotation path via the fixing belt, and (ii) comprise a magnetic flux generator that is positioned outside the rotation path and generates magnetic flux for causing an inductive heating layer of the fixing belt to generate heat. The image forming apparatus of the present invention may be any image forming apparatus as long as it comprises the above-described fixing device, whether image formation is performed in color or monochrome. Examples of such an image forming apparatus include a photocopier, a facsimile machine, and a multifunction peripheral (MFP).

(3) By way of example, the above embodiment has described a structure in which the fixing roller 102 and the pressurizing roller 103 are positioned side-to-side (FIG. 2). However, the fixing roller 102 and the pressurizing roller 103 are not limited to being positioned in such a manner, but may be positioned one above the other.

By way of example, the above embodiment has described a structure that conveys each sheet S such that the center of each sheet S traces the center of the conveyance path 35. However, the above embodiment is not limited to such a structure. For example, each sheet S may be conveyed so that one edge of each sheet S in the sheet width direction traces a referent position that is at a side of the conveyance path 35.

The present invention may be implemented based on any combination of the above embodiment and modification examples.

INDUSTRIAL APPLICABILITY

The present invention can be applied to a fixing device using an induction heating method.

REFERENCE SIGNS LIST

1 printer
40 fixer
101 fixing belt
102 fixing roller
103 pressurizing roller
104 magnetic flux generator
105 fixing nip
Db inner diameter of fixing belt
Dr outer diameter of fixing roller
L nip width
X inner diameter Db of belt/outer diameter Dr of roller
Y temperature increase speed rate

The invention claimed is:

1. A fixing device that causes a sheet on which an unfixed image is formed to pass through a fixing nip, and fixes the unfixed image onto the sheet by heat and pressure at the fixing nip, the fixing device utilizing an induction heating method and comprising:

a belt that is rotated, includes an induction heating layer and has a substantially hollow cylindrical shape;

a first roller positioned inside a rotation path of the belt;

a second roller that forms the fixing nip between an outer surface of the second roller and an outer surface of the belt by pressurizing the first roller from outside the rotation path via the belt; and a magnetic flux generator that is positioned outside the rotation path and generates magnetic flux for causing the induction heating layer of the belt to generate heat, wherein a rate X of an inner diameter of the belt to an outer diameter of the first roller satisfies a relationship $1<X\leqq1.18$.

2. The fixing device of claim 1, wherein the inner diameter of the belt is in a range between 40 [mm] and 50 [mm] inclusive.

3. The fixing device of claim 1, wherein when the inner diameter of the belt is 40 [mm], the outer diameter of the first roller is in a range between 34 [mm] and 39 [mm] inclusive.

4. The fixing device of claim 3, wherein the outer diameter of the first roller is in a range between 36 [mm] and 38 [mm] inclusive.

5. The fixing device of claim 1, wherein when the inner diameter of the belt is 50 [mm], the outer diameter of the first roller is in a range between 44 [mm] and 48 [mm] inclusive.

6. The fixing device of claim 5, wherein the outer diameter of the first roller is in a range between 46 [mm] and 48 [mm] inclusive.

7. The fixing device of claim 1, wherein a width of the fixing nip in a sheet conveyance direction is greater than or equal to 11 [mm].

8. The fixing device of claim 1, wherein provided that (i) a temperature increase speed Va denotes a magnitude of increase in a temperature of the belt per unit time, the magnitude being measured when the rate X is equal to 1 and therefore does not satisfy the relationship $1<X\leqq1.18$, (ii) a temperature increase speed Vb denotes a magnitude of increase in a temperature of the belt per unit time, the magnitude being measured for each value of the rate X that satisfies the relationship $1<X\leqq1.18$, and (iii) a temperature increase speed rate Y is obtained, for each pair of (a) the temperature increase speed Va and (b) a different one of the temperature increase speeds Vb, by dividing the temperature increase speed Vb by the temperature increase speed Va, in a case where a relationship between the values of the rate X and values of the temperature increase speed rates Y is displayed in a graph as a line, a segment of the line that corresponds to the values of the rate X satisfying the relationship $1<X\leqq1.18$ slopes in such a way that the values of the temperature increase speed rates Y increase as the values of the rate X increase until reaching an apex thereof, and thereafter decrease as the values of the rate X increase, and the rate X is set to a value that (i) satisfies the relationship $1<X\leqq1.18$ and (ii) corresponds to either the apex or one of the values of the temperature increase speed rates Y that is in a vicinity of the apex.

9. An image forming apparatus that forms an unfixed image on a sheet and causes a fixer included therein to fix the unfixed image onto the sheet, wherein the fixer is the fixing device of claim 1.

* * * * *